US007926538B2

(12) United States Patent
Coleman et al.

(10) Patent No.: US 7,926,538 B2
(45) Date of Patent: Apr. 19, 2011

(54) LATERAL RESTRAINT FOR A MOVABLE PARTITION, MOVABLE PARTITIONS INCORPORATING SAME AND RELATED METHODS

(75) Inventors: W. Michael Coleman, Salt Lake City, UT (US); Michael D. George, Kaysville, UT (US)

(73) Assignee: Won-Door Corporation, Salt Lake City, UT (US)

( * ) Notice: Subject to any disclaimer, the term of this patent is extended or adjusted under 35 U.S.C. 154(b) by 470 days.

(21) Appl. No.: 11/652,446

(22) Filed: Jan. 11, 2007

(65) Prior Publication Data

US 2008/0169069 A1 Jul. 17, 2008

(51) Int. Cl.
*E06B 9/06* (2006.01)

(52) U.S. Cl. ..... 160/84.08; 160/199

(58) Field of Classification Search ..... 160/84.08, 160/84.09, 84.11, 84.06, 199, 206, 1, 7, 331, 160/345

See application file for complete search history.

(56) References Cited

U.S. PATENT DOCUMENTS

| | | | | |
|---|---|---|---|---|
| 1,595,669 | A * | 8/1926 | Kurner | 160/126 |
| 2,027,992 | A | 1/1936 | Maurer | |
| 2,043,981 | A * | 6/1936 | Bickel | 160/126 |
| 2,151,033 | A | 3/1939 | Jones | |
| 2,736,373 | A * | 2/1956 | Truesdale | 160/124 |
| 3,082,817 | A * | 3/1963 | Merrill | 160/40 |
| 3,389,741 | A * | 6/1968 | Bean | 160/199 |
| 3,447,584 | A | 6/1969 | Smart | |
| 3,481,388 | A | 12/1969 | Smart | |
| 3,577,679 | A | 5/1971 | Petterborg | |
| 3,720,254 | A | 3/1973 | Smart | |
| 3,972,381 | A | 8/1976 | Gail | |
| 3,979,861 | A | 9/1976 | Fromme et al. | |
| 4,014,072 | A | 3/1977 | Schumacher | |
| 4,133,364 | A * | 1/1979 | Smart | 160/199 |
| 4,154,280 | A * | 5/1979 | Hashimoto | 160/84.11 |

(Continued)

FOREIGN PATENT DOCUMENTS

DE 2506469 8/1975

(Continued)

OTHER PUBLICATIONS

PCT International Search Report and Written Opinion for application No. PCT/US2008/050873, dated Oct. 7, 2008, 20 pages.

(Continued)

*Primary Examiner* — David Purol
(74) *Attorney, Agent, or Firm* — TraskBritt

(57) ABSTRACT

Methods and apparatuses are disclosed for laterally restraining a movable partition. In one embodiment, a movable partition includes two laterally spaced structures wherein each structure includes a plurality of hingedly coupled panels. A lateral restraint mechanism is located and configured to prevent lateral displacement of one or both of the two laterally spaced structures. In one embodiment, a cable is disposed between and extends from along the lower edge of the two laterally spaced structures. The cable is maintained in tension, at least while the partition is in a deployed condition, to prevent or minimize the lateral displacement of one or both of the structures such as when a draft or other external force acts on the structures. In one embodiment, the cable may be operatively associated with one or more drive components used to displace the movable partition. In another embodiment, the cable may be coupled to a take-up mechanism.

7 Claims, 7 Drawing Sheets

U.S. PATENT DOCUMENTS

| | | | | |
|---|---|---|---|---|
| 4,172,423 | A | | 10/1979 | Monne |
| 4,658,878 | A | | 4/1987 | Williams |
| 4,763,712 | A | | 8/1988 | van der Klaauw |
| 4,852,628 | A | | 8/1989 | Klein |
| 4,887,659 | A | | 12/1989 | West |
| 4,922,987 | A | | 5/1990 | Marontate et al. |
| 4,932,455 | A | | 6/1990 | Yamada |
| 4,957,600 | A | | 9/1990 | Carlson et al. |
| 5,025,846 | A | | 6/1991 | West |
| 5,065,807 | A | | 11/1991 | Maeda et al. |
| 5,143,137 | A | | 9/1992 | West |
| 5,295,527 | A | | 3/1994 | West |
| 5,411,072 | A | | 5/1995 | Starck et al. |
| 5,456,303 | A | | 10/1995 | Horinouchi |
| 5,477,902 | A | | 12/1995 | Kraeutler |
| 5,542,460 | A | | 8/1996 | McKeon |
| 5,577,348 | A | | 11/1996 | Keller |
| 5,749,407 | A | | 5/1998 | Brenner et al. |
| 5,828,972 | A | | 10/1998 | Asanuma et al. |
| 5,947,178 | A | * | 9/1999 | Patten ..... 160/193 |
| 6,035,918 | A | | 3/2000 | Kraeutler |
| 6,209,171 | B1 | | 4/2001 | Pelletier et al. |
| 6,223,804 | B1 | | 5/2001 | Toti |
| 6,267,169 | B1 | | 7/2001 | McDonald |
| 6,283,189 | B1 | | 9/2001 | Liebscher |
| 6,601,637 | B2 | | 8/2003 | Toti |
| 6,615,894 | B1 | | 9/2003 | McKeon |
| 6,662,848 | B2 | | 12/2003 | Goodman et al. |
| 6,766,847 | B1 | | 7/2004 | Wang |
| 7,478,663 | B2 | | 1/2009 | Goodman |
| 7,513,293 | B2 | | 4/2009 | Goodman |
| 2003/0226645 | A1 | | 12/2003 | Toti |
| 2008/0105389 | A1 | | 5/2008 | Goodman et al. |
| 2008/0115896 | A1 | | 5/2008 | Goodman |
| 2008/0264578 | A1 | | 10/2008 | Goodman et al. |

FOREIGN PATENT DOCUMENTS

| | | |
|---|---|---|
| DE | 2755157 | 6/1979 |
| DE | 29506707 | 7/1995 |
| DE | 202005000165 | 3/2006 |
| EP | 0111962 | 6/1984 |
| EP | 1630337 | 1/2006 |
| GB | 1226442 | 3/1971 |
| WO | 2005098189 | 10/2005 |

OTHER PUBLICATIONS

PCT International Search Report for Application No. PCT/US2007/083520, dated Mar. 25, 2008.

PCT International Search Report for Application PCT/US2007/083526, dated Oct. 7, 2008.

PCT International Search Report for Application No. PCT/US2008/061167, dated Oct. 14, 2008.

PCT International Search Report for Application No. PCT/US2008/085504 dated Feb. 24, 2009.

* cited by examiner

LATERAL RESTRAINT FOR A MOVABLE PARTITION, MOVABLE PARTITIONS INCORPORATING SAME AND RELATED METHODS

CROSS-REFERENCE TO RELATED APPLICATIONS

The subject matter of this application is related to the subject matter of U.S. application Ser. No. 11/951,901, filed Dec. 6, 2007, titled "MOVABLE PARTITIONS WITH LATERAL RESTRAINT DEVICES AND RELATED METHODS." The subject matter of this application is also related to the subject matter of U.S. application Ser. No. 12/756,066, filed Apr. 7, 2010, titled "METHOD, APPARATUS AND SYSTEM FOR CONTROLLING A MOVABLE PARTITION," which is a divisional application of U.S. application Ser. No. 11/796,325, filed Apr. 27, 2007, now U.S. Pat. No. 7,740,046 issued Jun. 22, 2010, titled "METHOD, APPARATUS AND SYSTEM FOR CONTROLLING A MOVABLE PARTITION." The subject matter of this application is also related to the subject matter of U.S. application Ser. No. 11/934,566, filed Nov. 2, 2007, titled "MOVABLE PARTITIONS WITH LATERAL RESTRAINT DEVICES AND RELATED METHODS."

BACKGROUND OF THE INVENTION

1. Field of the Invention

The present invention relates to movable partitions and, more particularly, to systems, apparatuses and methods for preventing lateral displacement of one or more portions of such partitions.

2. State of the Art

Movable partitions are utilized in numerous situations and environments for a variety of purposes. Such partitions may include for example, foldable or collapsible doors configured to close off an opening in order to enclose a room or to subdivide a single large room into one or more smaller rooms. The subdivision of a larger area may be desired, for example, to accommodate the simultaneous meeting of multiple groups. In such applications, movable partitions are useful for providing privacy and noise reduction.

Movable partitions may also be used to act as a security barrier, a fire barrier or as both. In such a case, the movable partition may be configured to automatically close upon the occurrence of a predetermined event such as the actuation of an associated alarm. For example, one or more movable partitions may be configured as a fire door or barrier wherein each door is formed with a plurality of panels connected to each other by way of hinge mechanisms. The hinged connection of the panels allows the door to fold up in a compact unit on one side of the opening or it may be stored in a pocket formed within a wall that is designed to conceal the door and preserve the aesthetics of the room where the door is installed. When deployment of the door is necessary, the door is driven by a motor along a track, which track may be incorporated into the header above the door, until the leading edge of the door, often defined by a component called a lead post, complementarily engages a mating receptacle. Such a mating receptacle may be referred to as a jamb or a door post when formed in a fixed structure (such as a wall), or as mating lead post when formed in another door or movable partition. In order for the door to securely close and form an adequate seal, the door's lead post and the doorjamb (or the mating lead post) must substantially align to enable mating engagement of such components and allow corresponding latch mechanisms to engage if desired.

However, even when a movable partition is properly closed, the door seal may be broken, for example, if the lower edge of the door is laterally displaced relative to the top edge of the door. Such lateral displacement of the lower edge of the door can be caused, for example, by a draft created by a fire, an improperly balanced HVAC system, or simply a person pushing on the door. When the seal is broken, smoke and flames may intrude around the door if the door is being used as a fire barrier. If the door is being used in a security installation, a person may sufficiently displace the door thereby allowing that person, or another, to slide or crawl underneath the door. At a minimum, displacement of the base of the door is unsightly and significantly reduces the door's effectiveness as a privacy screen and noise barrier.

One approach to preventing or controlling the lateral displacement of a door, including the door's lower edge, is to engage the lower edge of the door in a guide track that is either embedded in or otherwise attached to the floor. However, the use of a track can present various issues. For example, a track disposed in the floor can pose a safety issue, regardless of whether it protrudes above the floor or is recessed within the floor, potentially resulting in a person twisting an ankle or tripping and falling. Likewise, such a track may act as a significant obstacle for wheeled conveyances. Additionally, such a guide track, being exposed when an associated door is in a retracted state, is prone to damage and may act as a collection point for dirt and debris.

In view of the current state of the art, it would be advantageous to provide a method, apparatus and system to substantially secure a movable partition from lateral displacement. It would be additionally advantageous to provide a method, apparatus and system that substantially maintain the lateral position of a lower edge of a movable partition in order to maintain a seal effected by the partition without the use of a track.

BRIEF SUMMARY OF THE INVENTION

In accordance with various aspects of the present invention, movable partitions, lateral restraints for movable partitions and related methods are provided. For example, in one embodiment of the present invention, a movable partition is provided. The movable partition includes a first structure comprising a first plurality of panels hingedly coupled to one another. A lead post is coupled to a first end of the first structure. A cable has at least a portion thereof extending adjacent a length of a lower edge of the first structure. The movable partition may include a second structure comprising a second plurality of panels hingedly coupled to one another, wherein the first structure is laterally spaced from the second structure, and wherein the cable is disposed between the first structure and the second structure. The movable partition may further include a track configured to guide displacement of the lead post along a defined path and an actuating mechanism located and configured to displace the lead post relative to the track. The movable partition may include further features or alternative components as set forth in further detail hereinbelow.

In accordance with another embodiment of the present invention, another movable partition is provided. The movable partition includes a first structure comprising a first plurality of panels hingedly coupled to one another. The movable partition further includes a lateral restraint mechanism configured to limit lateral displacement of a lower edge of the first structure. The movable partition may include a second structure comprising a second plurality of panels hingedly coupled to one another, the first structure being laterally spaced from the first structure, wherein the lateral restraint mechanism is disposed between the first structure and the second structure.

In accordance with another aspect of the present invention, a method of operating a movable partition is provided. The method includes placing the movable partition in a deployed state and positioning a cable adjacent a length of a lower edge of the movable partition. The cable is maintained in tension while the movable partition is in the deployed state. Other and different acts may be included in association with the method of operating the door as will be apparent to those of ordinary skill in the art upon reading the detailed disclosure and the appended claims.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
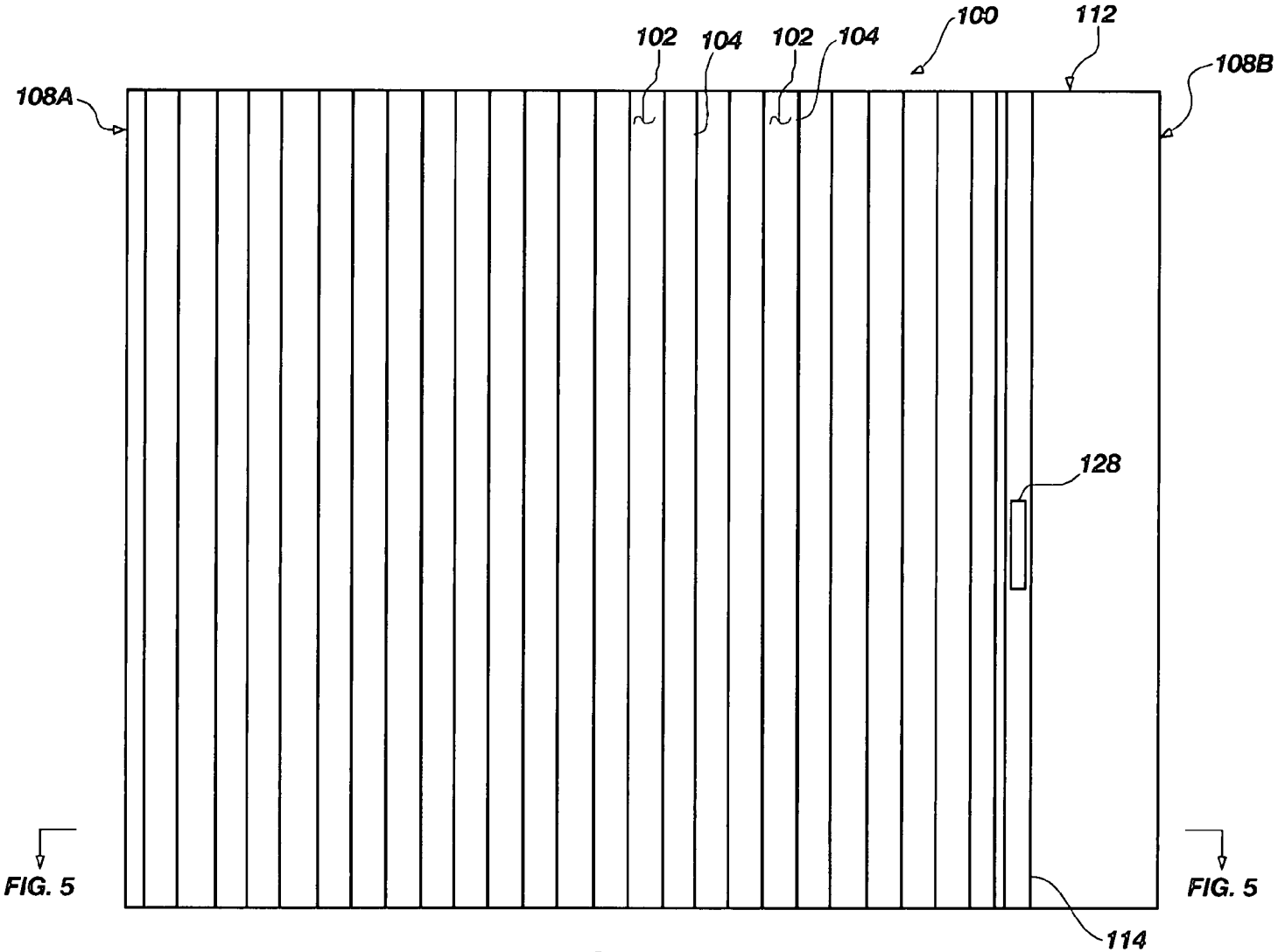
FIG. 1 is an elevation view of a movable partition in accordance with one embodiment of the present invention.
Figure 2:
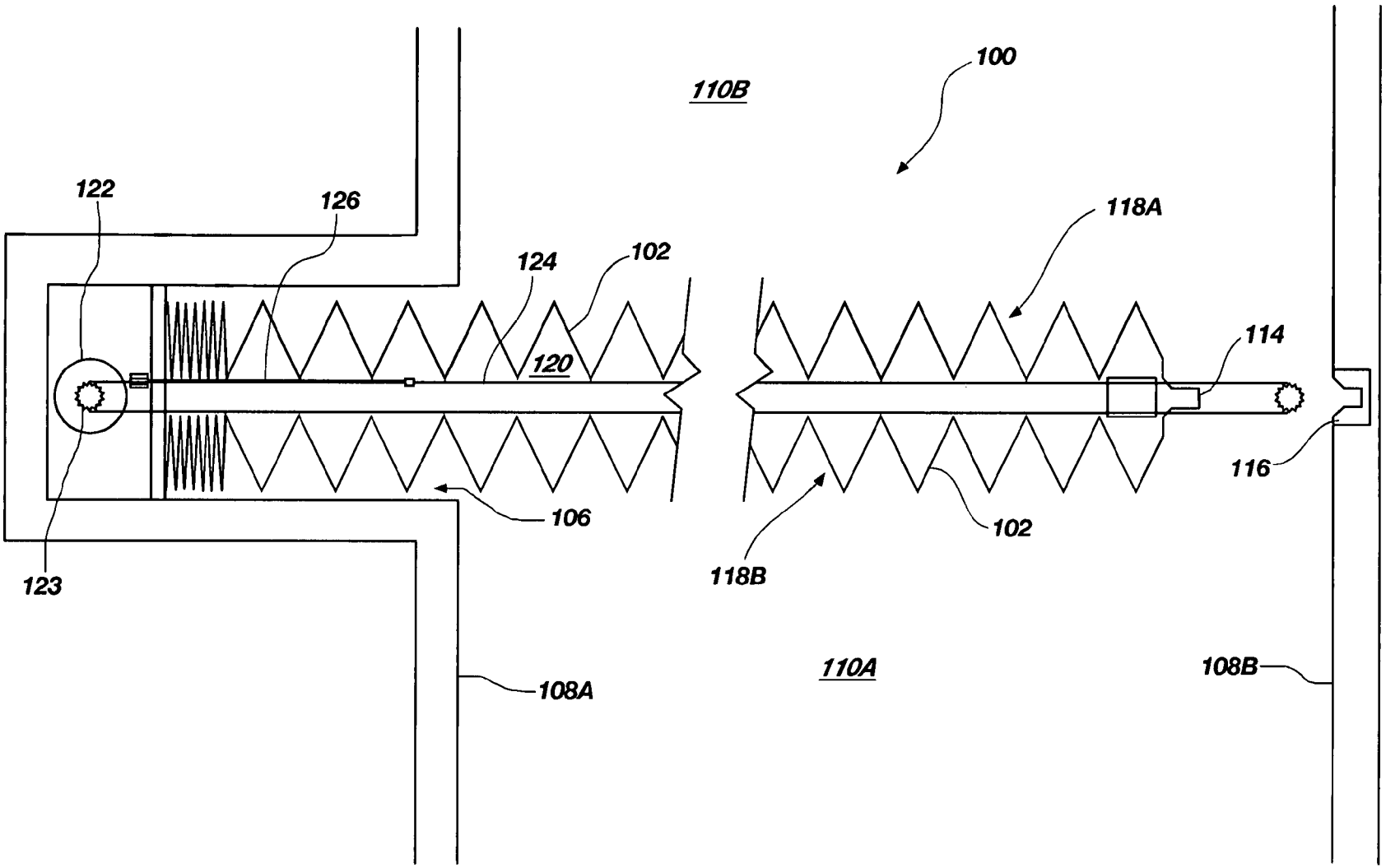
FIG. 2 is a plan view of the movable partition shown in FIG. 1.
Figure 3:
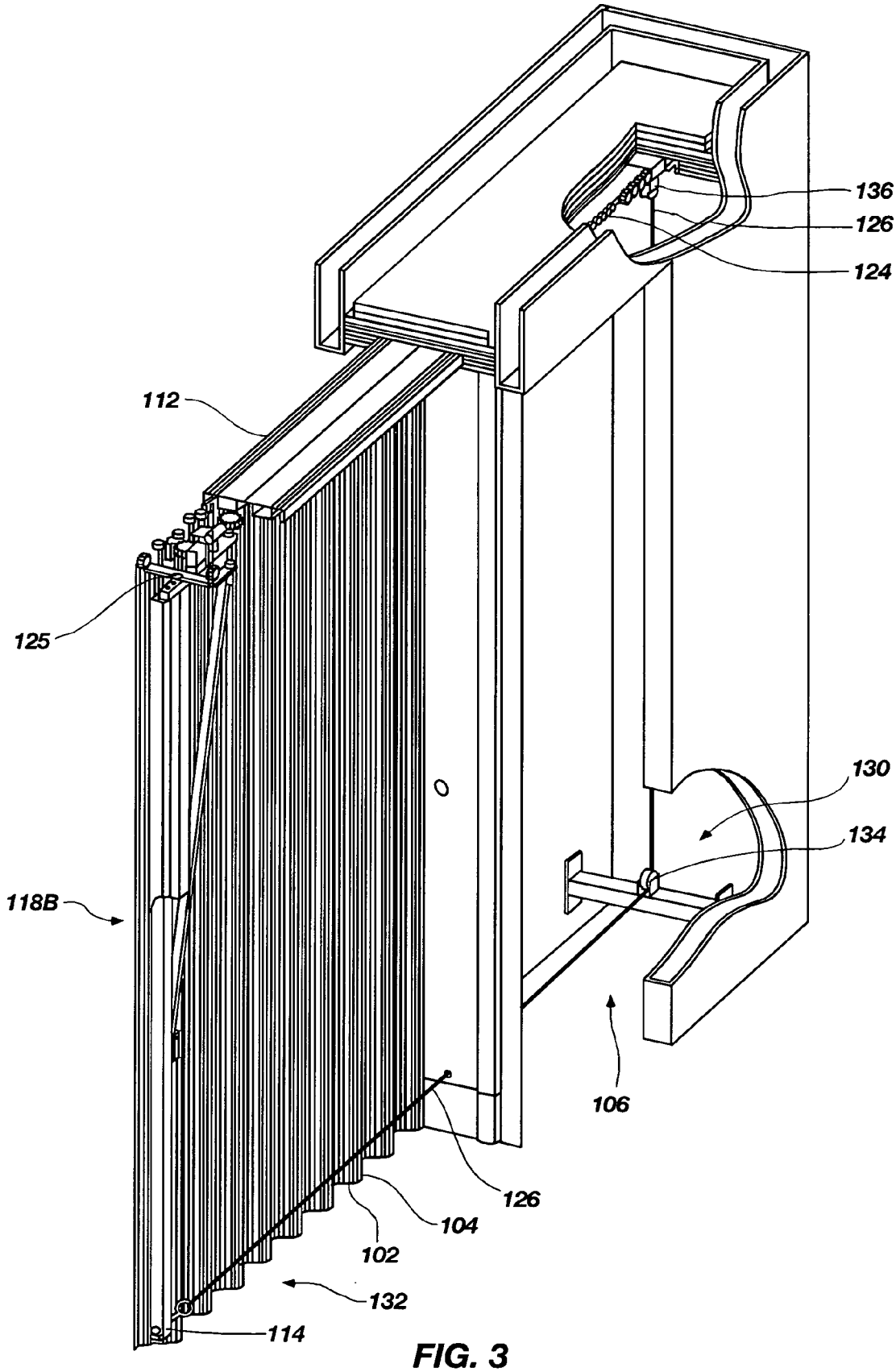
FIG. 3 a perspective view of a movable partition shown in FIGS. 1 and 2.

Referring to FIGS. 1 through 3, an elevation view, a plan view and a perspective view are shown, respectively, of a movable partition 100. It is noted that, in FIG. 3, various portions of certain structures or components are partially sectioned for sake of clarity and simplicity in showing various aspects of the described embodiment. In the example shown in FIGS. 1 and 2, the partition 100 may be in the form of a folding door. In certain embodiments, the partition 100 may be used, for example, as a security door, a fire door or as both. In other embodiments, the partition need not be utilized as a fire or security door, but may be used simply for the subdividing of a larger space into smaller rooms or areas.

The partition 100 may be formed with a plurality of panels 102 that are connected to one another with hinges or other hinge-like structures 104 in an alternating pattern of panel 102/hinge structure 104. The hinged connection of the individual panels 102 enables the panels to fold relative to each other in an accordion or a plicated manner such that the partition 100 may be compactly stored, such as in a pocket 106 formed in a wall 108A of a building when the partition is in a retracted or folded state.

When in a deployed state, the partition 100 may extend from one wall 108A to a second wall 108B to act as a barrier (e.g., a fire or security barrier) or to divide one area or room into multiple rooms 110A and 110B. When it is desired to deploy the partition 100 from a stowed condition to an extended position, for example, to secure an area during a fire, the partition 100 may be motivated along an overhead track 112 (see FIG. 3) across the space to provide an appropriate barrier. When in a deployed or an extended state, a leading edge of the partition 100, shown as a male lead post 114, may complementarily or matingly engage with a jamb or door post 116 that may be formed in a wall 108B of a building.

As best seen in FIG. 2, the partition 100 may include a first barrier or structure 118A and a second barrier or structure 118B, each including a plurality of panels 102 coupled with one another by way of hinges or hinge-like structures 104. The second structure 118B is laterally spaced from the first structure 118A. Such a configuration may be utilized as a fire door wherein one structure (e.g., structure 118A) acts as a primary fire and smoke barrier, the space 120 between the two structures 118A and 118B acts as an insulator or a buffer zone, and the another structure (e.g., structure 118B) acts as a secondary fire and smoke barrier. Such a configuration may also be useful in providing an acoustical barrier when the partition is used to subdivide a larger space into multiple, smaller rooms.

Various means may be used to displace the partition 100 from a stowed condition to a deployed condition and vice versa. For example, depending on the intended use of the partition 100, it may be displaced manually (i.e., by an individual pushing or pulling it along the track 112). In another embodiment, an appropriate actuator may be used to displace the partition 100. For example, a drive may include a motor 122 coupled to a pulley or gear 123 configured to drive a transmission member such as a belt or chain 124. In one embodiment of the present invention, a cable 126 may be coupled to the drive belt or chain 124 as a component of a lateral restraint mechanism as will be discussed in further detail below.

A portion of the belt or chain 124 may be coupled to a trolley 125 that is configured to ride along the track 112. The trolley 125 may be coupled to a component of the partition 100 such as, for example, the lead post 114. Thus, actuation of the motor 122 and belt or chain 124 in a first direction results in displacement of the trolley 125 and lead post 114 so that the partition may be deployed. Actuation of the motor 122 and belt or chain 124 in a second direction results in displacement of the trolley 125 and lead post 114 so that the partition may be retracted.

Additionally, while not specifically shown, various sensors and switches may be employed in association with such a drive to assist in the control of the partition 100. For example, as shown in FIG. 1, when used as a fire door, the partition 100 may include a switch or actuator 128, commonly referred to as "panic hardware." Actuation of the panic hardware 128 allows a person located on one side of the partition 100 (e.g., in room 110A) to cause the partition 100 to open if it is closed, or to stop while it is closing, so as to provide access through the barrier formed by the partition 100 for a predetermined amount of time.

It is noted that, while the above description has been more directed to an embodiment including a single partition 100 extending from one wall 110A to another wall 110B, other movable partitions may be utilized. For example, a two-door, or bi-part partition configuration may be utilized wherein two similarly configured partitions extend across a space and join together to form an appropriate barrier as will be appreciated by those of ordinary skill in the art.

Still referring to FIGS. 1 through 3, a lateral restraint mechanism 130 is operatively associated with the partition 100 to minimize or prevent lateral displacement of a lower edge 132 of the first structure 118A, the second structure 118B or both. In one embodiment, the lateral restraint mechanism 130 may include a cable 126, as previously mentioned, having one end thereof coupled to the lead post 114 and another end thereof coupled to a portion of the drive belt or drive chain 124. While generally referred to herein as a cable 126, it is noted that the term cable is intended to include other components, such as, for example, a wire, rope, chain or other elongated, elastically deformable structural member may be utilized.

The cable 126 extends between the lead post 114 and a first redirect structure or mechanism 134 such as, for example, a pulley or a static guide, located at a longitudinal end of the partition 100 opposite that of the lead post 114 (e.g., in or adjacent the door pocket 106, if a door pocket is being used). In one embodiment, the portion of the cable 126 extending between the door post 114 and the redirect mechanism 134 may also be disposed between, and extend substantially parallel to, the first and second structures 118A and 118B such that it is substantially concealed from a user after installation and during conventional operation of the partition 100.

Another portion of the cable 126 extends from the first redirect mechanism 134 to a second redirect mechanism 136, which may be located near the overhead track 112 such as, for example, near the motor 122. Again, the redirect mechanism 136 may include a dynamic mechanism, such as a pulley, or a static mechanism, such as an eyelet, a bent channel or some other similar structure. Yet another portion of the cable 126 extends from the second redirect mechanism 136 in a direction substantially parallel with the drive belt or drive chain 124 and has a portion thereof, such as at or near its end, coupled to a portion of the drive belt or drive chain 124.

Figure 4A:
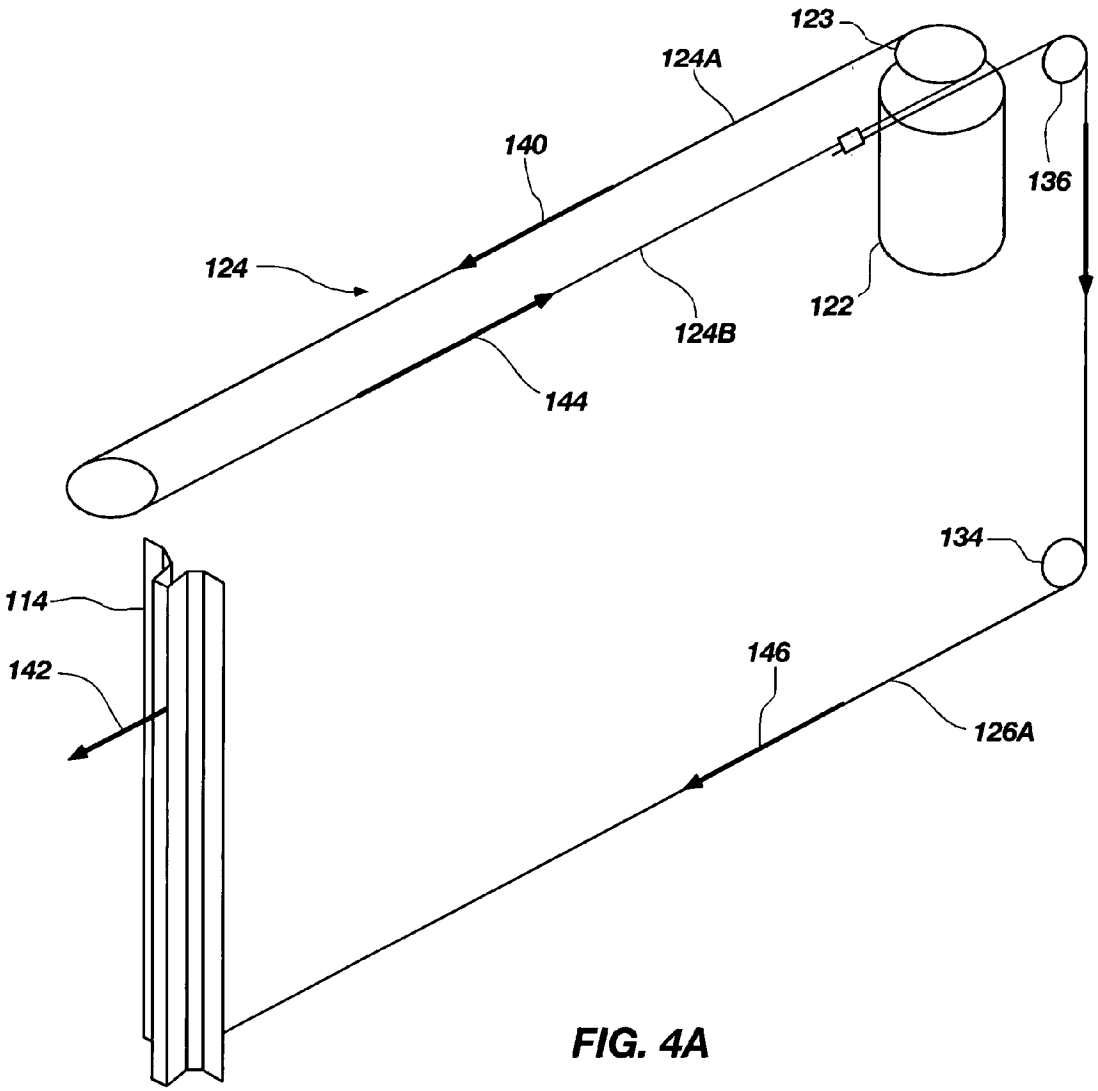
FIGS. 4A and 4B are schematics depicting various components of a movable partition during operation in accordance with an embodiment of the present invention.
Figure 4B:
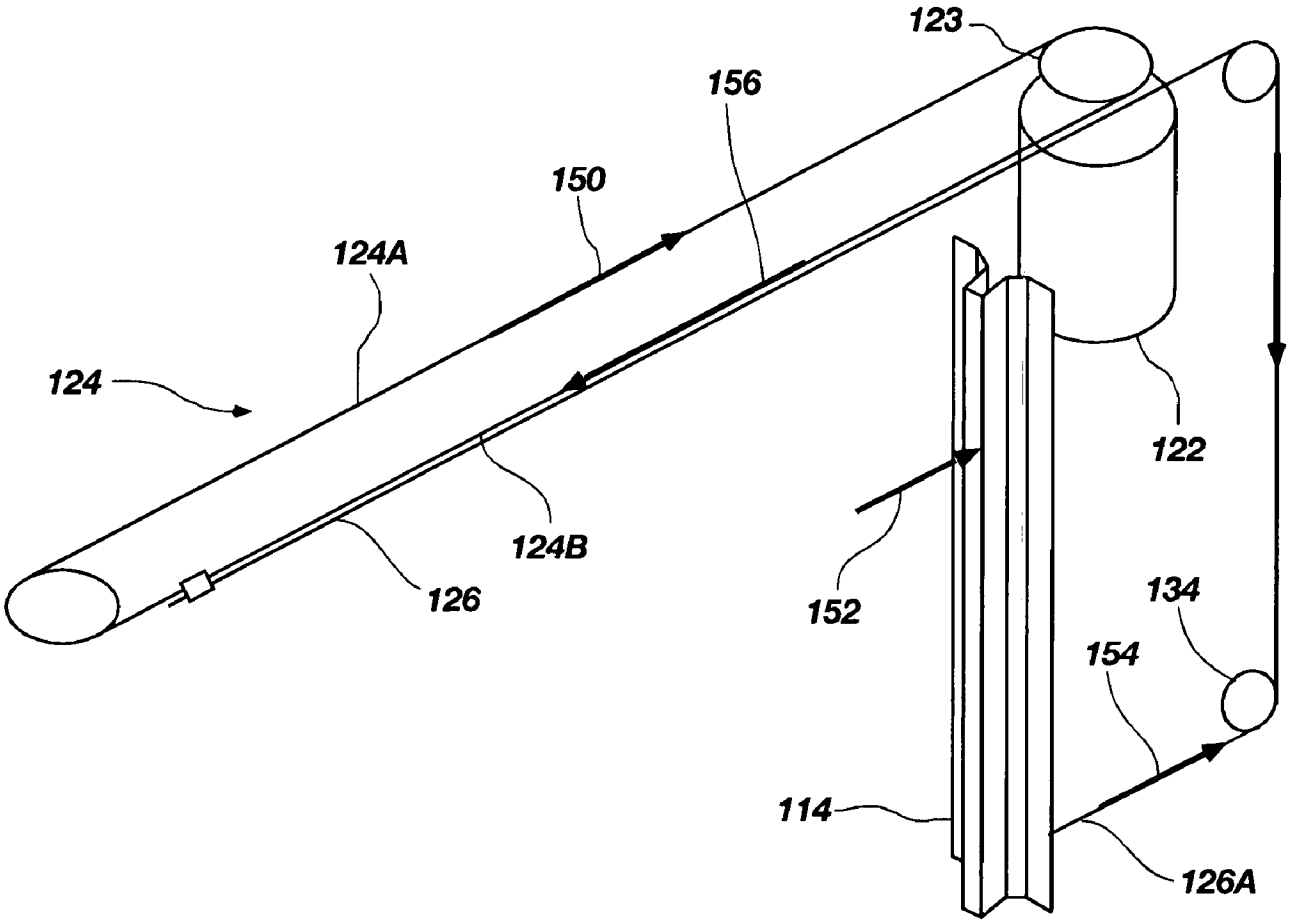

Referring briefly to the schematics shown in FIGS. 4A and 4B in conjunction with FIGS. 1 through 3, the drive belt or drive chain 124 may be configured as a circuitous structure. Thus, for example when actuated by the drive motor 122 to deploy or extend the partition (FIG. 4A), a first portion 124A of the drive belt or drive chain 124 travels in a first direction as indicated by directional arrow 140. As previously noted, the partition 100 is coupled to the drive belt or drive chain 124 such that the lead post 114 travels in the same direction as the first portion 124A of the drive belt or drive chain 124 (and accordingly motivates the various structures 118A and 118B with their associate panels 102 and hinge structures 104 in the same direction) as indicated by directional arrow 142. The portion 126A of cable 126 extending between the lead post 114 and the first redirect mechanism 134, it being coupled to the lead post 114, is likewise displaced in the same direction as that of the lead post 114 and as indicated by directional arrow 146.

A second portion 124B of the drive belt or drive chain 124, due to the circuitous configuration thereof, travels in a second direction that is opposite to that of the first direction, as indicated by directional arrow 144 (and which is, therefore, opposite the direction that the lead post 114 of the partition 100 is traveling).

If the partition 100 is being retracted (i.e., pulled back into the pocket 106), the drive motor 122 may displace the first portion 124A of the drive belt or drive chain 124 in a direction as indicated by directional arrow 150. The lead post 114 (along with panels 102 and hinge structures 104) travel in the same direction as the first portion 124A of the drive belt or drive chain 124 as indicated by directional arrow 152. The portion 126A of the cable 126 extending between the lead post 114 and the first redirect mechanism 134 travels in the same direction as the lead post 114 as indicated by directional arrow 154. The second portion 124B of the drive belt or drive chain 124 travels in a direction opposite to that of the first portion 124A, as indicated by directional arrow 156.

Thus, in operation, regardless of the position of the partition 100 (e.g., whether partially deployed, fully deployed, or fully retracted), the cable 126 is displaced concurrently with displacement of the lead post 114 (and other related components) such that a portion 126A extending adjacent the lower edge 132 of either or both of the first and second structures 118A adjusts in length to always remain relatively taut as it extends from the lead post 114 to the first redirect mechanism 134.

Figure 5:
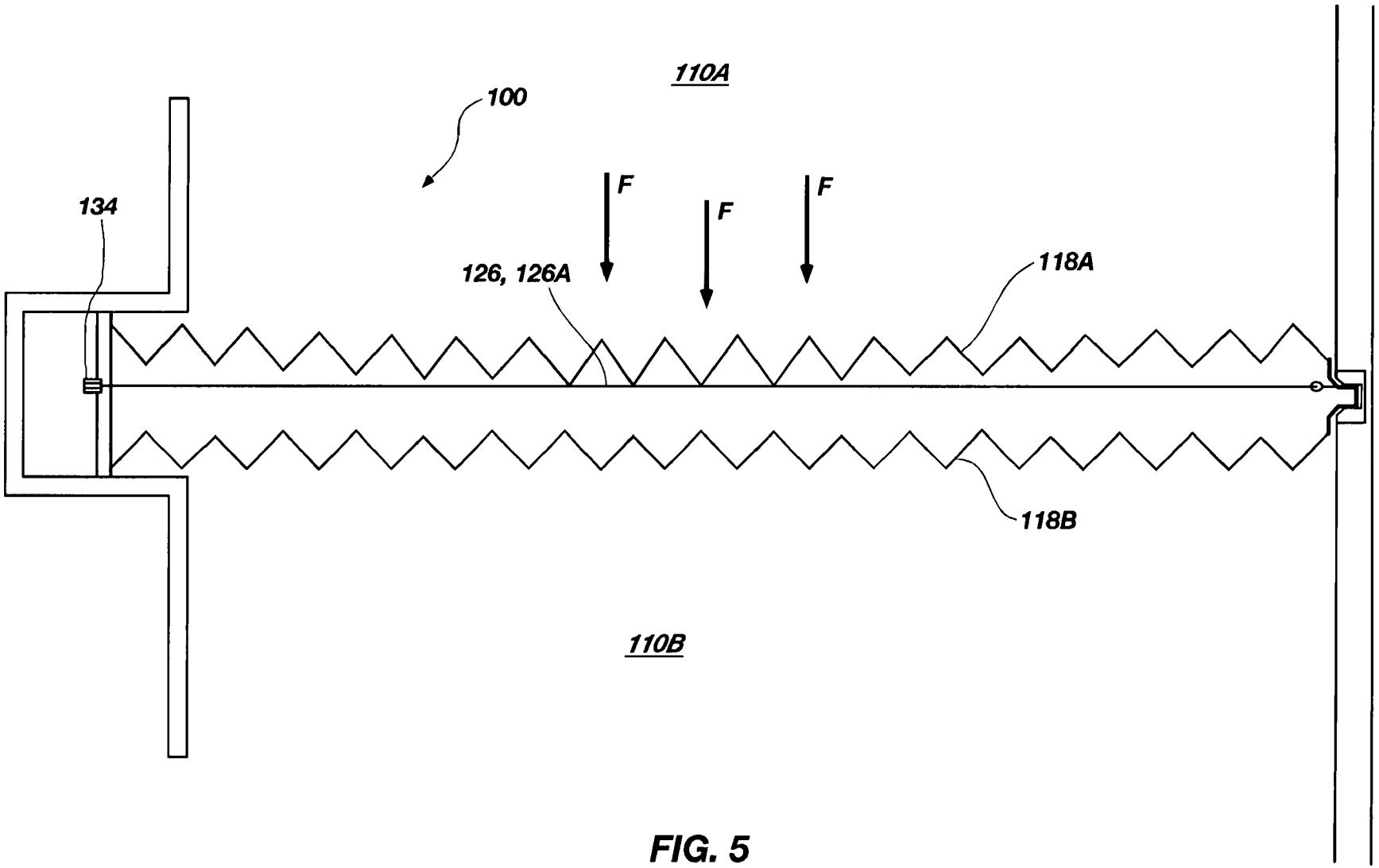
FIG. 5 is a sectioned view of the movable partition of FIG. 1 depicting the movable partition when an external lateral force is applied thereto.

By maintaining a desired level of tension in the portion 126A of the cable 126, the first and second structures 118A and 118B, or at least the lower edge 132 thereof, become limited in their ability to be laterally displaced (i.e., displaced in a direction generally perpendicular to the longitudinal direction in which the portion 126A of the cable 126 extends). For example, as shown in FIG. 5 (which depicts cross-sectional view of the partition as indicated by section lines 5-5 in FIG. 1) if a draft or other lateral force "F" is imposed on the first structure 118A of the partition 100, the first structure 118A becomes displaced, but only to the point of contacting the adjacent portion 126A of the cable 126. The cable 126 serves to limit the displacement of the first structure 118A when it is subjected to such a force and, thus, prevents or at least minimizes air leakage from one side of the partition 100 to the other (i.e., from room 110A to 110B). In other words, without a lateral restraint mechanism, the lower edge 132 of the first and second structures 118A and 118B could experience substantial lateral displacement when subjected to an external force such that a gap could be formed between the lower edge(s) 132 of the first and second structures 118A and 118B and the floor or other surface directly adjacent the lower edge(s) 132 of the first and second structures 118A and 118B, and thereby allow substantial fluid flow through such a gap. As previously noted, the development of such a gap would serve to diminish the purpose of the partition 100 when used as a fire barrier, a security barrier or even when used as a sound barrier. The variously described embodiments of the present invention minimize, if not prevent, substantial lateral displacement of the lower edges 132 of the first and second structures 118A and 118B without the requirement of a track formed in the floor or other surface over which the partition traverses.

Figure 6:
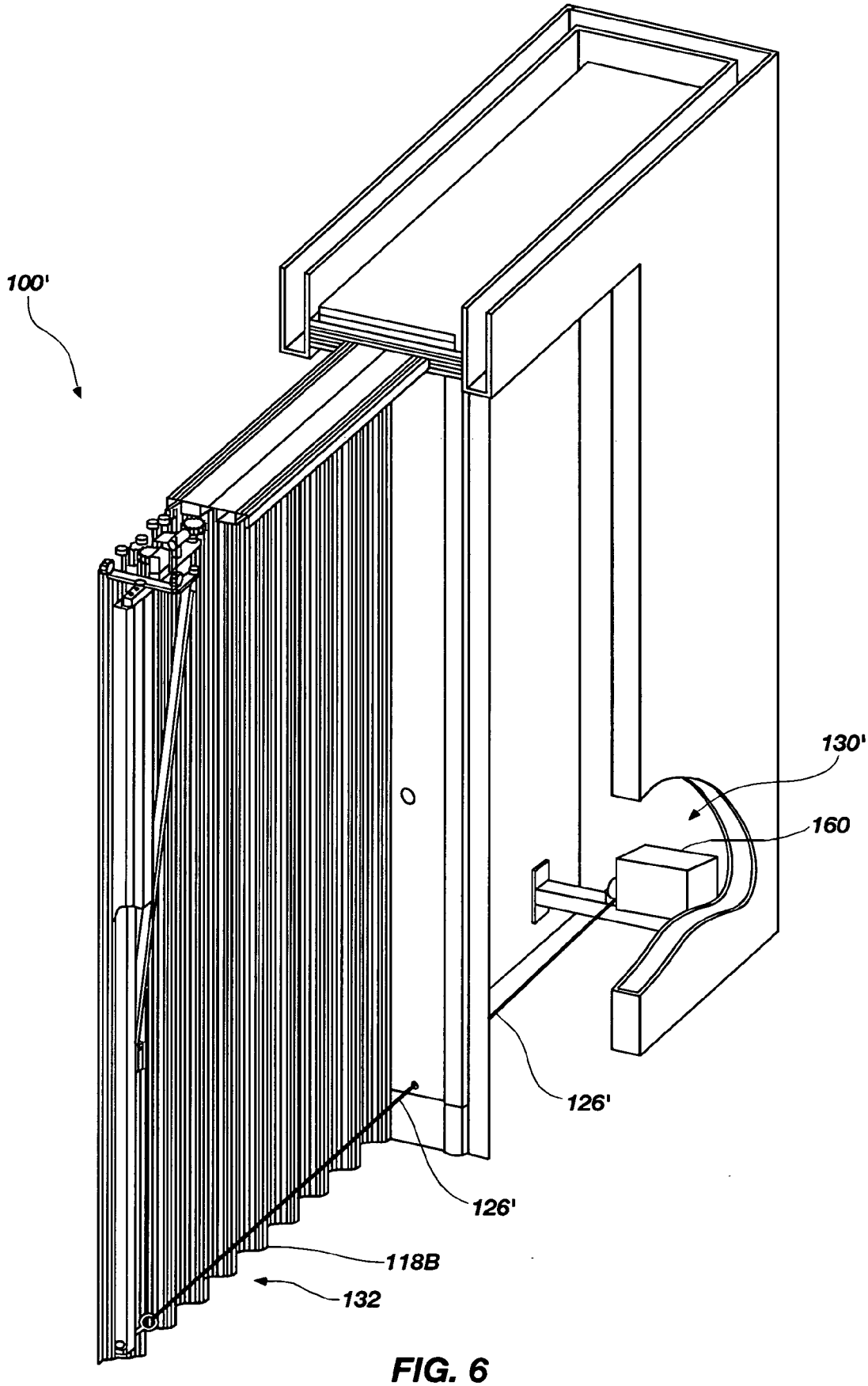
FIG. 6 is perspective view of a movable partition in accordance with another embodiment of the present invention.

Referring now to FIG. 6, a perspective view of a partition 100' is shown which incorporates a lateral restraint mechanism 130' in accordance with another embodiment of the present invention. The lateral restraint mechanism 130' may include a cable 126' or other structure that is coupled to the lead post 114 (or other component of the partition 100') at one end thereof and that is coupled to a take-up mechanism 160 at another end thereof. Thus, the cable 126' extends along the length of the partition 100' near the lower edge 132 of the first and/or second structures 118A and 118B (118A not shown in FIG. 6). The take-up mechanism 160 may be configured to deploy or retract the cable 126' concurrently, and in conjunction with, the deployment or retraction of the partition 100'. For example, the take-up mechanism 160 might include a drive, such as a stepper motor, configured such that upon deployment of the partition 100', the motor deploys the cable 126' at the same rate of deployment such that a desired level of tension is substantially maintained within the cable 126', but without hindering the travel of the lead post 114. Similarly, upon retraction of the partition 100', the take-up mechanism may be configured to retract the cable 126' at the same rate of retraction experienced by the partition 100'.

In another embodiment, the take-up mechanism 160 may include a drive or other device that enables the cable 126' to freely deploy until the partition 100' is fully deployed and then applies a retraction force on the cable 126' to induce a desired level of tension in the cable 126'.

The take-up mechanism 160 may also include various types of drives or other actuators. In another embodiment, for example, the take-up mechanism 160 may include a stored energy device such as coiled spring which allows deployment of the cable 126' upon displacement of the lead post 114 away from the take-up mechanism 160 while using the potential energy of the coiled spring to retract the cable 126' upon displacement of the lead post 114 in a direction toward the take-up mechanism 160. Such a mechanism might include a clutch or a braking device to control the storage and release of the stored energy.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition comprising:

a first structure comprising a first plurality of panels hingedly coupled to one another;

a lead post coupled to a first end of the first structure;

a trolley coupled to the lead post;

a cable having at least a portion thereof extending adjacent a length of a lower edge of the first structure and configured to limit lateral displacement of the lower edge of the first structure;

an actuating mechanism located and configured to displace the lead post relative to a track, the actuating mechanism comprising:

a drive; and a circuitous transmission member having a portion thereof adjacent the lead post and coupled to the trolley and another portion coupled to at least another portion of the cable, the circuitous transmission member configured to displace the lead post upon activation of the drive.

2. The movable partition of claim 1, further comprising a second structure comprising a second plurality of panels hingedly coupled to one another, the first structure laterally spaced from the second structure, wherein the cable is disposed between the first structure and the second structure.

3. The movable partition of claim 2, further comprising a track configured to guide displacement of the lead post along a defined path, the trolley being slidably coupled to the track.

4. The movable partition of claim 1, wherein the circuitous transmission member comprises a drive belt or a drive chain located and configured to displace the lead post upon actuation of the drive.

5. The movable partition of claim 1, further comprising at least one redirect mechanism configured to alter a direction of a portion of the cable.

6. The movable partition of claim 5, wherein the at least one redirect mechanism is located adjacent the lower edge of the first structure and adjacent a second end of the first structure, the second end of the first structure being opposite the first end of the first structure.

7. The movable partition of claim 5, wherein the at least one redirect mechanism includes two, spaced apart redirect mechanisms located adjacent a second end of the first structure, the second end of the first structure being opposite the first end of the first structure.

* * * * *